United States Patent [19]

Bollinger

[11] Patent Number: 4,976,237

[45] Date of Patent: Dec. 11, 1990

[54] ENGINE AIR INTAKE VALVE

[75] Inventor: Steven R. Bollinger, Chesterfield, Mo.

[73] Assignee: Carter Automotive Company, St. Louis, Mo.

[21] Appl. No.: 377,686

[22] Filed: Jul. 10, 1989

[51] Int. Cl.[5] ..... F02M 23/06

[52] U.S. Cl. ..... 123/339; 123/585; 251/129.11

[58] Field of Search ..... 123/339, 361, 399, 585, 123/587, 588, 589; 251/129.10, 129.11

[56] References Cited

U.S. PATENT DOCUMENTS

| | | | |
|---|---|---|---|
| 4,367,805 | 1/1983 | Totani et al. | 180/179 |
| 4,388,913 | 6/1983 | Grimm et al. | 123/339 X |
| 4,428,356 | 1/1984 | Kemmner | 123/339 X |
| 4,474,151 | 10/1984 | Atago et al. | 123/339 |
| 4,480,614 | 11/1984 | Kobashi et al. | 123/339 |
| 4,494,517 | 1/1985 | Kratt et al. | 123/339 X |
| 4,523,565 | 6/1985 | Omitsu | 123/399 |
| 4,526,060 | 7/1985 | Watanabe | 74/626 |
| 4,541,378 | 9/1985 | Kitamura | 123/333 |
| 4,658,783 | 4/1987 | Janetzke et al. | 123/339 |
| 4,724,811 | 2/1988 | Maisch | 123/361 |
| 4,771,750 | 9/1988 | Breitkreutz et al. | 123/585 X |
| 4,796,580 | 1/1989 | Wakeman | 123/339 |

*Primary Examiner*—Willis R. Wolfe

*Attorney, Agent, or Firm*—Lawrence J. Shurupoff

[57] ABSTRACT

An engine air intake valve for controlling engine idling speed includes a rotary electrical actuator for actuating a rotary slidable valve element across a flow port in a cylindrical valve seat. The flow port is rectangular so that each unit angular movement of the valve element produces the same in air flow rate. The rotary electrical actuator includes a stator having a wire wound therearound to produce two opposed magnetic poles at diametrically-spaced points on the stator circumference.

20 Claims, 4 Drawing Sheets

FIG 6
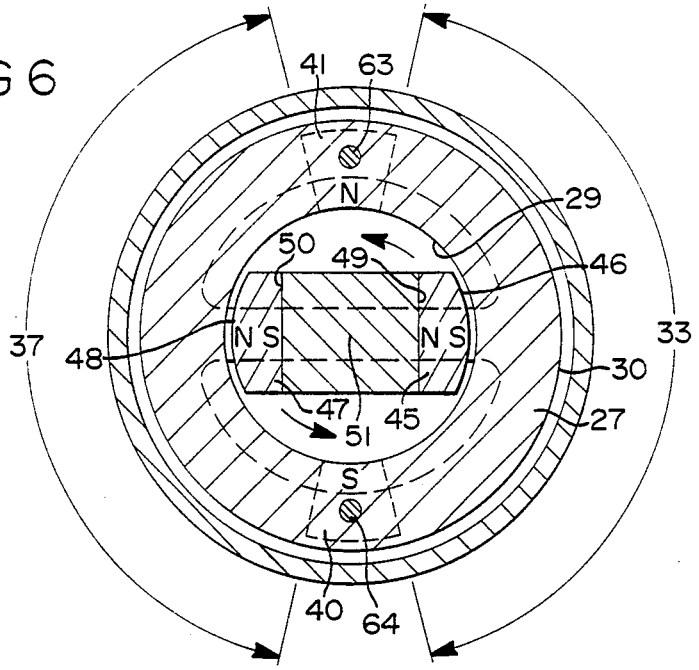
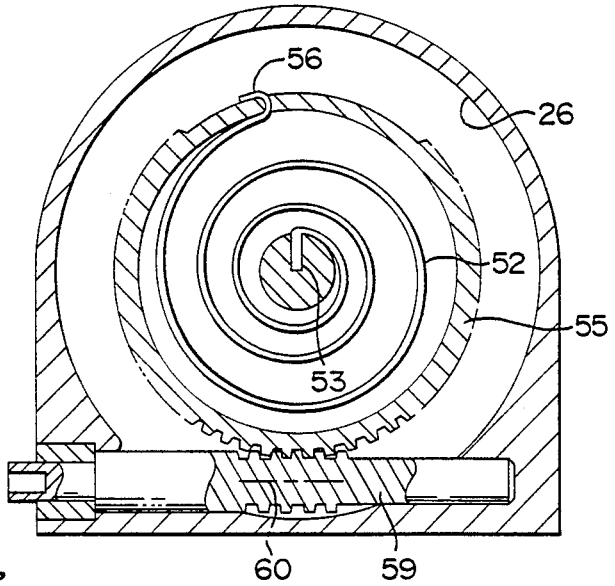
FIG 7

ENGINE AIR INTAKE VALVE

TECHNICAL FIELD

This invention relates to automotive engines, and particularly to adjustment devices employed on an engine air intake valve to regulate the no-load or idling speed of the engine to compensate for sudden load changes.

BACKGROUND ART

Various prior art devices are known for the purpose of controlling automotive engine no-load idling speeds. It is common to set such engines at the lowest possible speed to conserve fuel. However, should a power-consuming device such as an air conditioner be turned on at idle speed, the engine may stall.

Prior art devices include that shown in W. Maisch U.S. Pat. No. 4,724,811 wherein an electro-magnetic adjustment mechanism is used to adjust the position of a throttle valve in accordance with different operating parameters (e.g. temperature, pressure and speed). The valve itself adjusts to different conditions to artificially increase or decrease the flow of air supplied to the engine. Similarly, in H. Janetzke U.S. Pat. No. 4,658,783 there is shown a solenoid-operated by-pass valve used to augment the air supplied to the engine through the throttle valve.

DISCLOSURE OF INVENTION

The present invention comprises a rotary, electrically-operated air valve as an air intake valve constructed to provide an essentially linear response to input current, and input current alone, and having a heretofore unattainable low hysteresis.

A rotary slide valve is operated by a rotary electric actuator. The valve includes a movable valve element which is formed as an integral extension of the electrical rotor. The electrical rotor is disposed concentrically within an annular cylindrical stator. Electrical windings on the stator produce a circumferential magnetic field that causes the rotor to rotationally deflect by an angular distance related to the magnitude of the current supplied to the stator windings. A return spring is connected to the rotor to return it to a zero-deflect position when the current is removed from the stator windings One object of the invention is to provide an engine air intake valve that is relatively small and light, e.g. four inches long and three-fourths of a pound in weight.

Another object is to provide a rotary electrically-operated air valve that has an essentially linear response to input current, i.e. each unit current change produces substantially the same air flow change over the valve operating range.

A further object is to provide a rotary air valve wherein the flow control element is substantially unaffected by air pressure or air flow, i.e. a valve that is pneumatically balanced so that flow rate is determined solely by the input current, not by air pressure forces acting to artificially keep the valve open or closed.

An additional object is to provide a rotary air valve that has a low hysterisis, i.e. a valve that can arrive at the same position from the flow-increase mode or the flow-decrease mode with the same input current applied.

An overall object is to provide an air valve that can be manufactured at relatively low cost and that has a fairly wide operating range (air flow rate and current input), such that one valve design can be used in a variety of different applications or in a range of different vehicles, with little or no modification of the valve structure Yet another object is to provide an air valve having a relatively large flow capacity for a given size, e.g. up to about twenty-five cubic feet per minute with a valve having an overall length of about four inches.

Other objects and features of the invention will be apparent in the following description and claims in which the principles of the invention are set forth together with details to enable a person skilled in the art to practice the invention.

BRIEF DESCRIPTION OF DRAWINGS

FIGS. 4 through 7 are sectional views taken, respectively on lines 4—4, 5—5, 6—6 and 7—7 in FIG. 2.

BEST MODE FOR CARRYING OUT THE INVENTION

Figure 1:
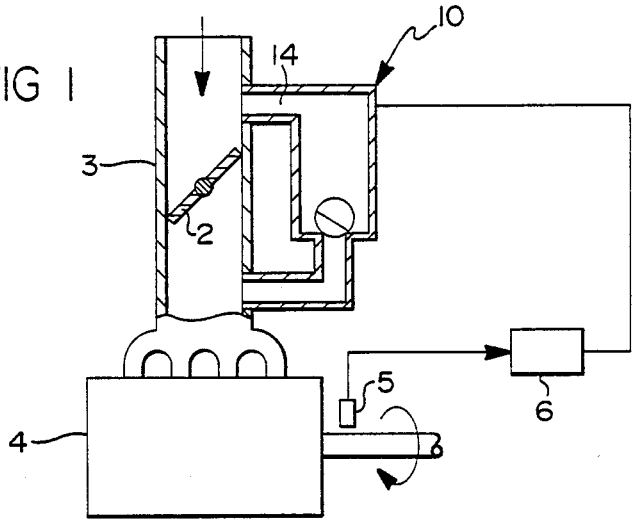
FIG. 1 is a schematic representation of the valve system according to the invention.

In FIG. 1, the system to which my invention pertains includes an air valve 10, described below, positioned across a throttle valve 2 within a main air intake passage 3 leading to an engine 4. An output or engine speed sensor 5 is provided to continuously sense the output speed of the engine. The output of sensor 5 is received by a conventional generator/transmitter 6 which transmits a representative electrical regulating signal to the electrical rotary actuator described below of air valve 10.

Figure 2:
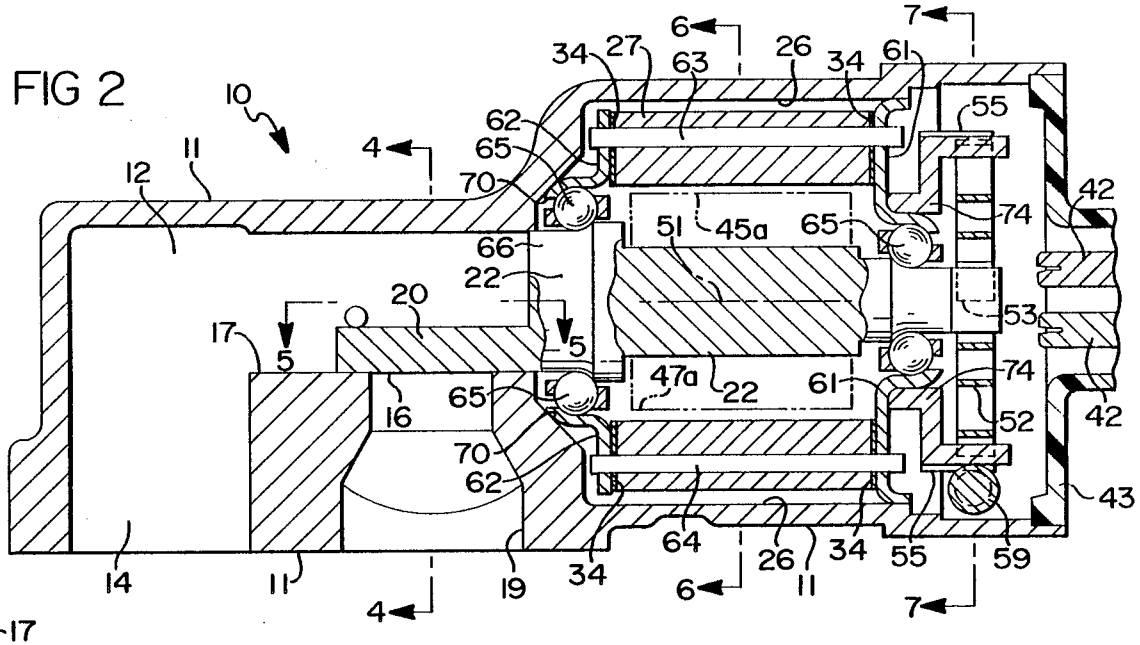
FIG. 2 is a sectional view taken through an engine air intake valve embodying the invention.
Figure 5:
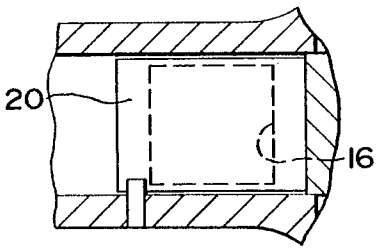

As seen in FIG. 2, the air valve 10 comprises a housing 11 preferably formed of aluminum or other non-magnetically permeable material. The housing is internally contoured (machined) to form a cylindrical valve chamber 12 that connects to an air intake port or duct 14. The flow port and valve seat are defined by a rectangular port 16 in the cylindrical chamber surface 17. As shown in FIG. 5, port 16 in plan view is square; however it could be rectangular and still achieve the same performance characteristics. It could also be of some other shape but then the response characteristics would be non-linear. Port 16 communicates with a cylindrical air discharge duct or passage 19.

Figure 4:
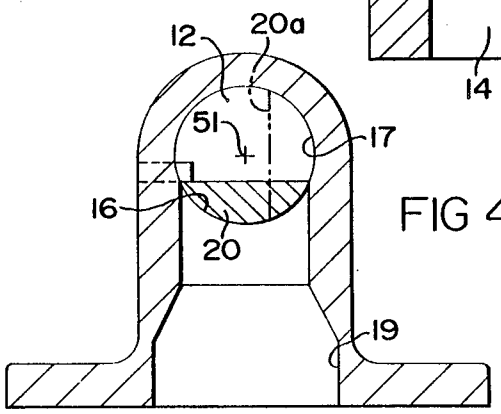

The movable flow control element comprises a segment-shaped wall structure 20 that is an integral extension of an electrical rotor 22. FIG. 4 shows flow control element 20 in its closed position, i.e. a position preventing flow from chamber 12 through port 16. The dashed lines **20*a* in FIG. 4** illustrate the flow control element in its full open position, although the element will not necessarily reach that position; various intermediate partially-open positions are possible. Flow rate is related to the valve element position.

The valve can be used so that passage 19 is an inlet passage and passage 14 is a discharge passage. Flow control element 20 is constructed so that air pressure forces have negligible effect on the valve-opening or valve-closing action. Moreover, the direction of flow through port 16 is not critical to valve performance.

The cylindrical surface of element 20 moves generally across and perpendicular to the direction of flow so that air pressure acts primarily on the edge area of the valve, thus minimizing the pressure effects on the valve element movement. The edge area of element 20 is very small areawise so that the effect of air pressure on valve performance is negligible. The valve is essentially balanced.

The rectangular nature of flow port 16 (FIG. 5) is advantageous in that each unit angle rotational increment of motion produces the same change in flow area and hence the same increment of change in flow rate. Given an electrical actuator having a linear, straight line response to its applied electrical current, there will be obtained a corresponding linear flow rate response. The sensitivity of the valve to applied current will be essentially uniform throughout the operating range of the valve (between positions 20 and 20*a* in FIG. 4).

The electrical actuator for the air valve is mounted or contained within a cylindrical chamber 26. The actuator includes the aforementioned rotor 22 and a surrounding electrical stator 27 formed of metal that is magnetically permeable. As shown best in FIG. 3, the stator is formed as an annular cylindrical structure having an inner annular side surface 29 and an outer annular side surface 30. An electrical winding, formed out of a single insulated wire, is wound radially and axially around two separate sections of the stator.

Referring again to FIG. 3, the single wire includes a first lead wire section 31 that extends downwardly alongside outer surface area 30 of the stator. The wire is then wound around the stator annulus a number of times, e.g. one hundred twenty turns, for a circumferential distance of about one hundred fifty degrees. Numeral 33 in FIG. 6 references the circumferential extent of this portion of the winding.

Figure 3:
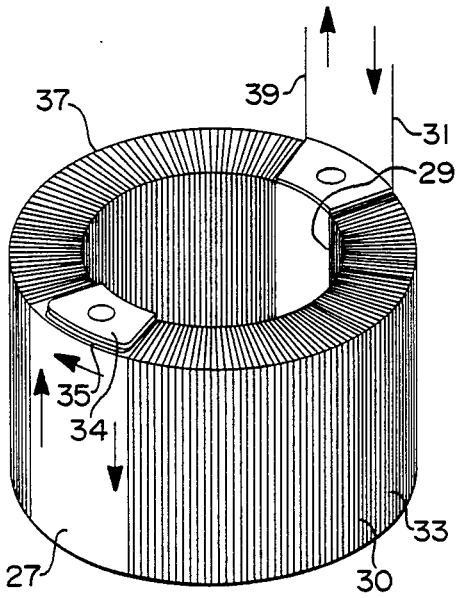
FIG. 3 is a perspective view of a stator construction used in the FIG. 2 valve.

As further seen in FIG. 3, each end surface of stator 27 has an upstanding spacer member 34 affixed thereon. The insulated wire extends partially around the outer edge of the spacer, as at 35, thence radially along the end surface of the stator and downwardly along the stator inner surface 29.

The wire is thereafter wound around the remaining portion of the stator annulus a like number of times, e.g. one hundred twenty turns, for a like circumferential distance of about one hundred fifty radial degrees. Numeral 37 (FIG. 6) references the described circumferential distance. The wire includes a second lead section 39 (FIG. 3) extending along outer surface 30 of the stator in near proximity to lead section 31. Eventually the two lead wire sections 31 and 39 are connected to terminals 42 that are suitably mounted in a dielectric cover 43 (FIG. 2).

The transition wire section 35 (FIG. 3) causes a change in the direction of the windings, i.e. the winding section represented by numeral 33 has a different electro-magnetic direction than the windings represented by numeral 37. Physically windings 33 travel downwardly on the stator outer surface, whereas windings 37 travel upwardly on the stator outer surface, as indicated by the arrows in FIG. 3. When a direct current is applied to the winding the different directions taken by the two winding sections produce two magnetic poles at the two zones 40 and 41 on the stator (between wound sections 33 and 37 in FIG. 6).

Thus, the magnetic poles are accurately defined over a limited range of the stator. Moreover, the windings 33, 37 are magnetically coupled in opposite directions so as to virtually eliminate all inductance characteristics of the windings. This eliminates voltage spikes and therefore simplifies the control circuitry of the rotor and reduces electromagnetic interference, particularly radio frequency interference which is an important consideration in automotive applications.

The "single wire" electrical winding comprised of winding sections 33 and 37 is, in many instances, preferably only one layer thick in order to provide a relatively smooth stator inner surface and to minimize the magnetic gap between the stator and rotor magnetic circuits. In other applications, a multiple layer winding may be preferred. In each instance, the optimum balance must be struck between cost and preformance.

FIGS. 2 and 6 show the magnetic features of the rotor. Two permanent magnets 45 and 47 are secured to flat surfaces 49 and 50 formed on the rotor. The magnets have the same configuration. However, magnet 45 is magnetized so that its outer cylindrical surface 46 has a south polarity, whereas magnet 47 is magnetized so that its outer cylindrical surface 48 has a north polarity. Two additive magnetic circuits are established across the rotor and stator, as indicated by the dashed lines in FIG. 6. Direct current applied to terminals 42, 42 (FIG. 2) causes rotor 22 to rotate in a counter clockwise direction around central axis 51 (FIG. 6).

Each rotor magnet 45 or 47 extends a substantial axial distance along the length of rotor 22. Dashed lines 45*a* and 47*a* in FIG. 2 show the positions the two magnets would assume if they were to fully align with stator poles 41 and 40, a condition produced at both "zero current" and "full current". In practice, the rotor is designed to be restrained by spring 52, as explained below, such that its deflection at half current or power will be ninety radial degrees (FIG. 6) from the FIG. 2 dashed line "zero/full current" position.

The magnetic deflection of rotor 22 is opposed by a spiral leaf spring 52, whose inner end is attached to rotor 22, as at 53 (FIG. 7). The outer end of the leaf spring is anchored to an annular ring gear 55, as at 56. Gear 55 is normally retained in a stationary position, such that counter clockwise magnetic deflection of the rotor loads up the spring. The spring can thereby return the rotor to the FIG. 6 position when current is removed from the stator windings. Spring 52 also provides a graduated biasing force on the rotor, so that a relationship can be established between applied current and air flow rate (as per FIG. 8). Air flow rate through port 16 is related directly to rotor deflection.

Figure 8:
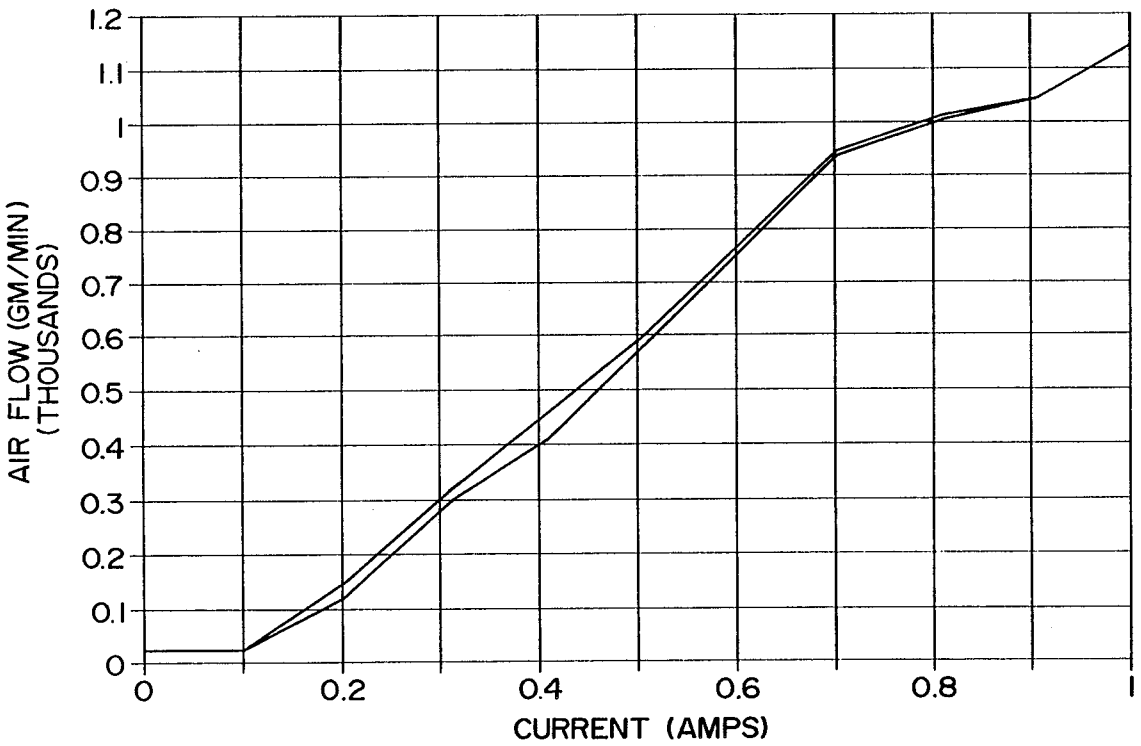
FIG. 8 is a chart depicting air flow against applied current for a valve constructed as shown in FIG. 2.

Manufacturing tolerances and variances are such that it may be necessary to vary or adjust the force developed by spring 52 at the zero current condition. The spring force-varying means can include a worm gear or screw 59 in mesh with the ring gear as shown in FIGS. 2 and 7. Manual rotation of screw 59 around its axis 60 adjusts the rotated position of ring gear 55, to thereby adjust the initial spring force. Screw 59 is in the nature of a calibration mechanism to initially set the spring force at the desired value necessary to establish the predetermined curve intercept (Point A) on the graph depicting applied current versus rotor deflection (FIG. 8).

Rotor 22 is rotatably supported by ball bearings located within annular end plates 61 and 62 that are carried on the ends of stator 27. As shown in FIG. 2, two axially extending pins 63 and 64 are press fit into openings in the stator. The ends of these pins are located in openings in plates 61 and 62, such that the plates are oriented properly to the stator. A spacer 34 is located on each end of the stator, at each pin 63 or 64, to prevent the electrical wire from becoming pinched between the stator end surface and the adjacent face of plate 61 or 62.

The inner annular surface of each end plate 61 or 62 is suitably configured to form a stationary race for anti-friction ball bearings 65. Likewise, annular surface areas on rotor 22 are configured to form movable races for the ball bearings, such that rotor 22 is adequately supported for rotation within annular stator 27. This design minimizes tolerance stack ups between the rotor and stator so as to provide a uniform clearance therebetween and thus helps to maintain the linear relationship of FIG. 8.

The stator-rotor assembly (components 22, 27, 61 and 62) is preferably installed as a unit into cylindrical chamber 26 in housing 10, by axial insertion of the assembly through the right end of the housing. Rotor 22 includes a cylindrical pilot section 66 that has a rotary sliding fit in the cylindrical valve chamber 12. Pilot section 66 acts as a partition to seal the space between chambers 12 and 26. Pilot section 66 also facilitates proper insertion during installation of the stator-rotor assembly into housing 10.

The outer peripheral edge of radial end plate 61 has an interference press fit in the cylindrical surface that defines chamber 26. As the stator-rotor assembly is fully forced into housing 11 the peripheral surface of end plate 61 seats tightly against the chamber 26 surface. At the same time the race-forming portion of radial end plate 62 moves against a frusto-conical end surface 70 at the left end of chamber 26. Surface 70 supports end plate 62 against radial dislocation or play. Since surface 70 is in direct engagement with outer surface areas of the ball bearing race, the bearing loads are absorbed (handled) by surface 70. The relatively thin gage material used to form the stationary race cannot deflect or vibrate even though the material is thin gage.

The aforementioned ring gear 55 includes an inner flanged area 74 that closely surrounds the outer surface of the ball bearing race formed on end plate 61. Flange 74 has a sliding fit on the race wall so that gear 55 can be adjusted by manual screw 59.

FIG. 8 charts the relationship between current and air flow for a valve constructed as shown in FIG. 2. The two curves are fairly close together along the X axis, indicating a fairly low hysterisis operational character. Also, the two curves are approximately linear in nature over a range of current inputs.

One feature of interest is the low hysterisis operation of the valve. A contributing factor is the rotary sliding movement of flow control element 20, whereby the element can reverse its direction with minimal interference from the air flowing through port 16. Another contributing factor is the fact that stator 27 and rotor 22 are connected together as a sub-assembly prior to insertion into housing 11.

The rotor and stator can be accurately connected so that the rotor is centered in the stator, i.e. with the rotor axis coincident with the stator axis, and with no obliqueness between the two axes. By having the two axes coincident the air gap between the rotor and stator is maintained essentially constant throughout the angular stroke of the rotor, thereby contributing to a low hysterisis operation.

It will be noted that flow control element 20 is an integral extension of rotor 22. The one-piece structure is the only movable component in the assembly, other than the anti-friction balls. By making the movable component as a relatively small integral structure it is possible to reduce its mass, thereby reducing the magnetic forces needed to move the structure.

The one-piece nature of the rotor-valve element component is also advantageous in that the valve element is indirectly supported by the anti-friction bearings. The cylindrical surface of element 20 can be in very close proximity to chamber surface 17 without having pressure engagement between the two surfaces. This means less frictional wear and also less frictional resistance to valve element motion.

A further advantageous feature is the construction of spring 52. The spring is located beyond the end of rotor 22 so that it can have a relatively long total length. Stress per unit spring length can be relatively low, thereby increasing the spring reliability factor. Also, the mounting gear 55 can be rotated through a relatively great rotational distance, if necessary, to calibrate the system. A precisely controlled spring force is achievable.

Another feature of interest is the relatively long angular stroke distance of rotor 22. The rotor stroke is ninety radial degrees, such that flow control element 20 can produce substantial changes in the size of port 16 as the rotor undergoes full angular deflection.

Stator 27 and rotor 22 are designed so that the stator axial length is somewhat greater than the axial lengths of rotor magnets 45 and 47, as will be seen from FIG. 2. The direct magnetic flux path is spaced axially inwardly from the extreme ends of the stator so that stray magnetic flux into the bearings or housing 11 becomes less of a problem. There are fairly large air gaps between the rotor magnets and the bearings.

While the best mode for carrying out the invention has been described in detail, those familiar to the art to which this invention relates will recognize various alternative designs and embodiments for practicing the invention as defined by the following claims.

What is claimed is:

1. In combination with an internal combustion engine, a system for regulating engine speed by regulating the air flow across a throttle valve in an air intake passage, said system comprising an engine air intake valve and means for sensing an operating variable representative of engine speed and sending an electrical signal representative of the engine speed to said engine air intake valve, said engine air intake valve comprising a common housing having a first actuator chamber and a second valve chamber, a rotary electrical actuator mounted in said first chamber, said actuator comprising an electrical rotor, said second valve chamber defining an air passageway having an inlet on one side of said throttle valve and an outlet on the other side of said throttle valve, said rotor comprising an axial extension having a cylindrical side surface movable rotationally along a cylindrical surface of said second valve chamber, and a flow port in said cylindrical side surface of said second valve chamber intermediate the inlet and outlet thereof, the area of said flow port being determined by the rotational position of said axial extension of said rotor across said flow port in response to the electrical signal generated by said sensing means.

2. The combination of claim 1 wherein said rotor has two axially-spaced ball bearing races formed thereon, whereby the rotor is supported for rotation within the actuator chamber.

3. The combination of claim 1 wherein the rotor comprises a permanent magnet assembly secured between the ball bearing races.

4. The combination of claim 1 further comprising a stator having electrical windings on two different sections of the stator; the windings on the different stator sections having different electrical directions.

5. The combination of claim wherein the flow port is rectangular.

6. An engine air intake valve comprising an electrical rotary actuator and a flow control element rotatable around the actuator axis to vary the flow rate through the valve; said actuator comprising an annular cylindrical stator, a rotor located in the space circumscribed by the stator, and an electrical winding on two different sections of the stator;

said winding comprising a single insulated wire wound radially and axially around the stator surface so that the windings on one section of the stator have a different electrical direction than the windings on the other section of the stator.

7. The valve of claim 6 wherein the single insulated wire includes a first lead wire section on an outer surface area of the stator, a first number of windings extending from the first lead wire section around and along the stator circumference for about one hundred fifty degrees; said stator having a spacer on one of its end surfaces; said insulated wire including a direction-change section extending partly around said spacer and onto the inner surface of the stator; said insulated wire including a second number of windings extending around and along the stator circumference from the direction-change section for a distance of about one hundred fifty degrees; said insulated wire further including a second lead wire section on an outer surface of the stator in near proximity to the first lead wire section.

8. The valve of claim 6 wherein the stator includes two diametrically-spaced zones having no electrical windings thereon, said zones defining opposite magnetic poles.

9. The valve of claim 8 wherein the rotor includes two permanent magnets polarized to move toward the magnetic poles on the stator when the electrical winding is energized.

10. The valve of claim 9 and further comprising a return spring means acting on the rotor so that when the electrical winding is energized to one-half of full power the rotor magnets are located midway between the stator poles.

11. The valve of claim 10 and further comprising means for varying the force of the spring means on the rotor.

12. An engine air intake valve comprising a housing, an electrical rotary actuator and flow control element disposed within said housing, said flow control element being rotatable around the actuator axis to vary the flow rate through the valve; said actuator comprising an annular cylindrical stator, a rotor located in the space circumscribed by the stator, and rotary support means between the rotor and stator;

said rotary support means comprising a first radial end plate at one end of the stator, diametrically-spaced locator elements for securing the stator to the radial end plates, first ball bearing races formed on said end plates, second ball bearing races formed at axially-spaced points on the rotor, and anti-friction balls rollably engaged in said races whereby the rotor axis is accurately aligned with the stator axis.

13. The valve of claim 12 wherein the first radial end plate includes a peripheral surface having a press fit in the housing whereby the rotor is accurately oriented relative to the housing; said housing defining a cylindrical valve chamber remote from said first radial end plate; said rotor including a cylindrical pilot section extending into the valve chamber to accurately orient the rotor relative to the valve chamber.

14. The valve of claim 13 wherein the cylindrical valve chamber comprises a cylindrical surface having a rectangular opening therein that defines a flow port.

15. The valve of claim 14 wherein the flow control element comprises an extension of the rotor, said rotor extension having a cylindrical side surface having sliding facial contact with the cylindrical valve chamber surface so as to move across the rectangular flow port.

16. The valve of claim 14 wherein the housing includes a frusto-conical surface concentric with the valve chamber axis; the second radial end plate having its ball bearing race engaged with said frusto-conical surface so that the housing provides support for the engaged race.

17. An engine air intake valve comprising a rotary actuator and a rotary flow control element, said actuator including a rotor that has an integral axial extension thereon configured to form the rotary flow control element;

a permanent magnet assembly secured to said rotor; and an electrical stator surrounding said rotor and having electrical windings provided thereon.

18. The valve of claim 17 wherein the rotor has two ball bearing races formed at axially-spaced points along the rotor surface, and a permanent magnet assembly secured between the two ball bearing races.

19. The valve of claim 18 wherein the rotor extension has a cylindrical flow control surface centered on the rotor axis.

20. The valve of claim 18 wherein the rotary actuator includes two circumferentially-spaced electrical windings on the stator for establishing two magnetic poles thereon.

* * * * *